US005962824A

United States Patent [19]

Ahn

[11] Patent Number: 5,962,824

[45] Date of Patent: Oct. 5, 1999

[54] TRIP LINK STRUCTURE FOR CIRCUIT BREAKER

[75] Inventor: Hee Il Ahn, Cheongju, Rep. of Korea

[73] Assignee: LG Industrial Systems, Co., Ltd., Seoul, Rep. of Korea

[21] Appl. No.: 09/095,072

[22] Filed: Jun. 10, 1998

[51] Int. Cl.[6] ..... H01H 3/00

[52] U.S. Cl. ..... 200/17 R; 200/18

[58] Field of Search ..... 218/2, 5, 58, 44, 218/71, 78, 119, 152, 7; 200/18, 401, 337

[56] References Cited

U.S. PATENT DOCUMENTS 4,744,002 5/1988 Nakano et al. ..... 361/341
4,774,628 9/1988 Diaferia et al. ..... 361/335

*Primary Examiner*—Michael L. Gellner
*Assistant Examiner*—Nhung Nguyen

[57] ABSTRACT

A trip link structure for a circuit breaker is disclosed and includes a plurality of circuit breakers arranged in a triangle shape and each having a fixed contact point and a movable contact point formed therein for thereby forming one unit including three circuit breakers as one unit with respect to three phases and an operational rod connected with the movable contact point, a main body engaging plate engaged to a front surface of the circuit breaker of each phase, a support bracket engaged to a front surface of each phase of the main body engaging plate, an operational link plate having a first connection portion hinged to the operational rod and a second connection portion supported by the first connection portion of a support bracket, a connection link having an upper end hinged to a third connection portion of the operational link plate connected with the circuit breaker of the upper side for thereby being downwardly extended and a lower end hinged to the third connection portion of the operational link plate connected with the circuit breaker of the lower side for thereby being upwardly extended, and a connection lever having a first connection portion connected with the lower end of the upper-side connection link and the upper end of the connection link of the lower side, a second connection portion supported by the second connection portion of the support bracket, and a third connection portion hinged to the driving lever.

12 Claims, 5 Drawing Sheets

TRIP LINK STRUCTURE FOR CIRCUIT BREAKER

BACKGROUND OF THE INVENTION

1. Field of the Invention

The present invention relates to a trip link structure for a circuit breaker, and in particular to an improved trip link structure for a circuit breaker which is capable of enabling a reliable operation of the circuit breaker by minimizing the construction of the same by providing a trip link structure and the identical operational distance between a driving lever and a circuit breaker of each phase.

2. Description of the Conventional Art

Generally, the circuit breaker is used for separating the lines of an underground power distributing line when an electric power is supplied to a power receiving device via a power distribution system provided with an overhead power distributing line and a underground power distributing line.

The conventional circuit breaker having a trip link structure will be explained with reference to FIGS. 1 and 2.

First, in a main body 10, circuit breakers 20*a*, 20*b* and 20*c* are arranged, each circuit breaker being installed to correspond with its phase.

The circuit breakers 20*a*, 20*b* and 20*c* are installed in an insulation tube (not shown), respectively, and each of the circuit breakers 20*a*, 20*b* and 20*c* includes a fixed contact point (not shown) and a movable contact point (not shown). One end of the movable contact point is connected with a corresponding one of the insulation rods 25*a*, 25*b* and 25*c* and the insulation rods 25*a*, 25*b* and 25*c* are connected by pin joints.

At this time, the end portions of the circuit breakers 20*a*, 20*b* and 20*c* among a plurality of circuit breakers are connected with a corresponding input terminal through which the electric power is inputted, and the other end portions of the circuit breakers are connected with a corresponding output terminal through which the electric power is outputted.

The other ends of the circuit breakers 20*a*, 20*b* and 20*c* act as operational rods 30*a*, 30*b* and 30*c* outwardly protruded through the insulation rods 25*a*, 25*b* and 25*c* connected with the movable contact points (not shown) and the operational rod connection portions 26*a*, 26*b* and 26*c*.

A main body engaging plate 40 is engaged to the front surfaces of the circuit breakers 20*a*, 20*b* and 20*c* by a plurality of fixing pins 50.

Support members 60*a*, 60*b* and 60*c* are disposed to be parallel to the operational rods 30*a*, 30*b* and 30*c*.

Next, connection links 90*a*, 90*b* and 90*c* are provided. Each of the intermediate portions of the connection links 90*a*, 90*b* and 90*c* is operably connected with a corresponding one of the support members 60*a*, 60*b* and 60*c*, and one end of each of the same is connected with a corresponding one of driving levers 80*a*, 80*b* and 80*c* connected with an operable mechanism 70, and the other end of each of the same is connected with a corresponding one of the operational rods 30*a*, 30*b* and 30*c*, so that the connection links 90*a*, 90*b* and 90*c* are movable forwardly and backwardly by the operation of the operable mechanism 70 for thereby enabling the operation of the points of the circuit breakers 20*a*, 20*b* and 20*c*.

In the drawings, characters "a", "b"and "c" represent the phase type of the electric power.

In other words, the character "a" is given with respect to the phase A of the electric power. Here, the phases of the electric power may be changed.

The operation of the conventional trip link structure will now be explained with reference to the accompanying drawings.

First, when the driving levers 80*a*, 80*b* and 80*c* of each phase are turned counterclockwise by the inner operation of the operable mechanism 70, the connection links 90*a*, 90*b* and 90*c* of each phase are rotated clockwise with respect to the support members 60*a*, 60*b* and 60*c* of each phase.

When the connection links 90*a*, 90*b* and 90*c* are rotated clockwise, the operational rods 30*a*, 30*b* and 30*c* are forwardly pulled, so that the movable contact points (not shown) connected with one end portion of the insulation rods 25*a*, 25*b* and 25*c* connected through the operational rod connection portions 26*a*, 26*b* and 26*c* are separated from the fixed contact points (not shown).

In the state that the fixed contact points (not shown) are separated therefrom, when the operation rod connection portions 26*a*, 26*b* and 26*c* are inwardly moved again, the connection operation is implemented in the reverse sequence of the separation sequence.

However, in the conventional trip link structure, if the circuit breakers are horizontally installed, the width of the structure is widened. In addition, if the circuit breakers are perpendicularly installed, the height of the structure may be increased. Therefore, the trip link structure may be made bulky.

SUMMARY OF THE INVENTION

Accordingly, it is an object of the present invention to provide a trip link structure for a circuit breaker which overcomes the problems encountered in the conventional art.

It is another object of the present invention to provide a trip link structure for a circuit breaker which is capable of minimizing the circuit breaker by deceasing the width and height of the structure of the same by arranging the phases of the circuit breaker in a triangle shape and enabling the operation of each circuit breaker by identically forming the operational distance between a driving lever and an operational rod of the circuit breaker.

To achieve the above objects, there is provided a trip link structure for a circuit breaker unit which includes a plurality of circuit breakers arranged in a triangle shape and each having a fixed contact point a movable contact point and an operational rod connected with the moveable contact point, for thereby forming one unit including three circuit breakers for three respective phases. A main body engaging plate is engaged to a front surface of the circuit breaker of each phase. Support brackets are engaged to a front surface of the main body engaging plate. Operational link plates have a first connection portions hinged to operational rod and second connection portions supported by first connection portions of the support brackets. A connection link having an upper end is hinged to a third connection portion of an operational link plate connected with the circuit breaker of the upper side portion of the circuit breaker unit for thereby being downwardly extended. Another connection link having a lower end is hinged to the third connection portion of another operational link plate connected with the circuit breaker of the lower side portion of the circuit breaker unit for thereby being upwardly extended. A connection lever having a first connection portion is connected with the lower end of the upper-side connection link. Another connection lever having a first connection portion is connected with the upper end of the lower-side connection link. Second connection portions of the connection levers are supported by second connection portions of the support brackets, and third connection portions of the connection levers are hinged to the driving lever.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The structure of a trip link for a circuit breaker according to the present invention will now be explained with reference to the accompanying drawings.

Figure 1:
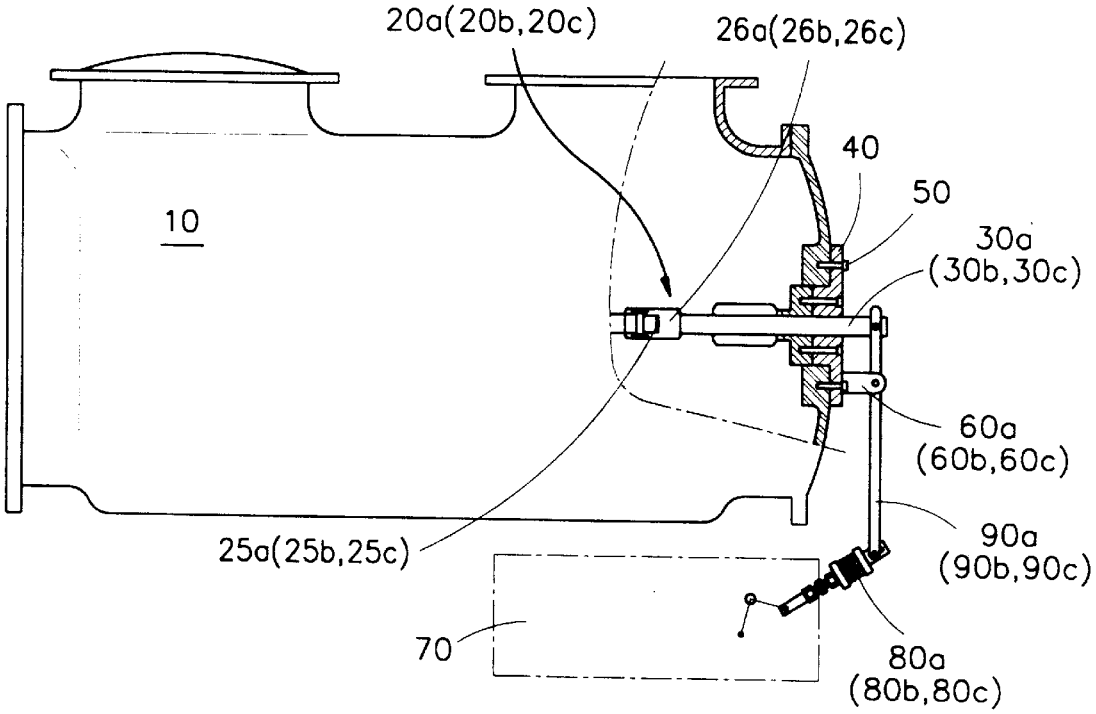
FIG. 1 CONVENTIONAL ART
FIG. 1 is a left side view illustrating a partially cut-away portion of a conventional circuit breaker having a trip link structure.
Figure 2:
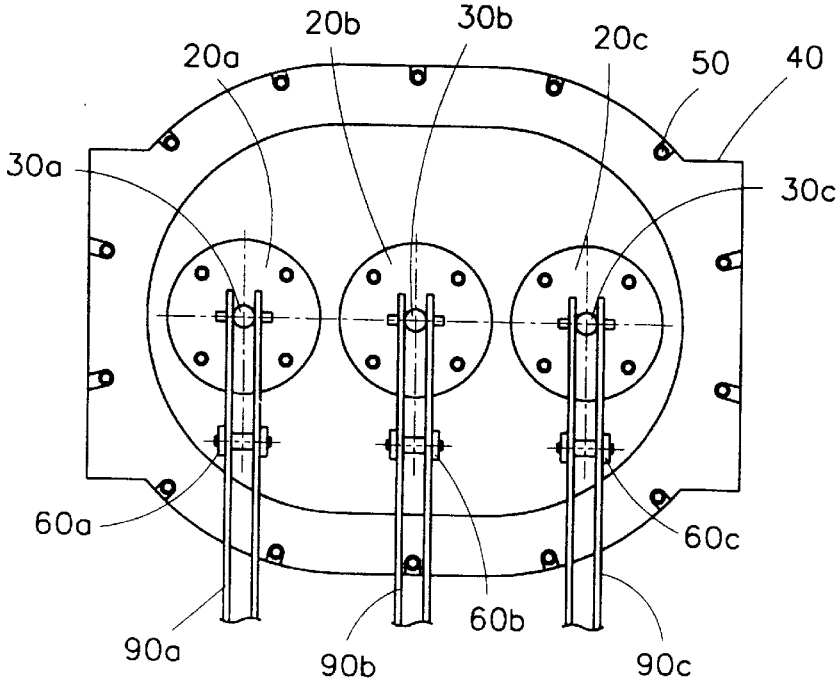
FIG. 2 CONVENTIONAL ART
FIG. 2 is a front view illustrating the arrangement of conventional circuit breaker.
Figure 3:
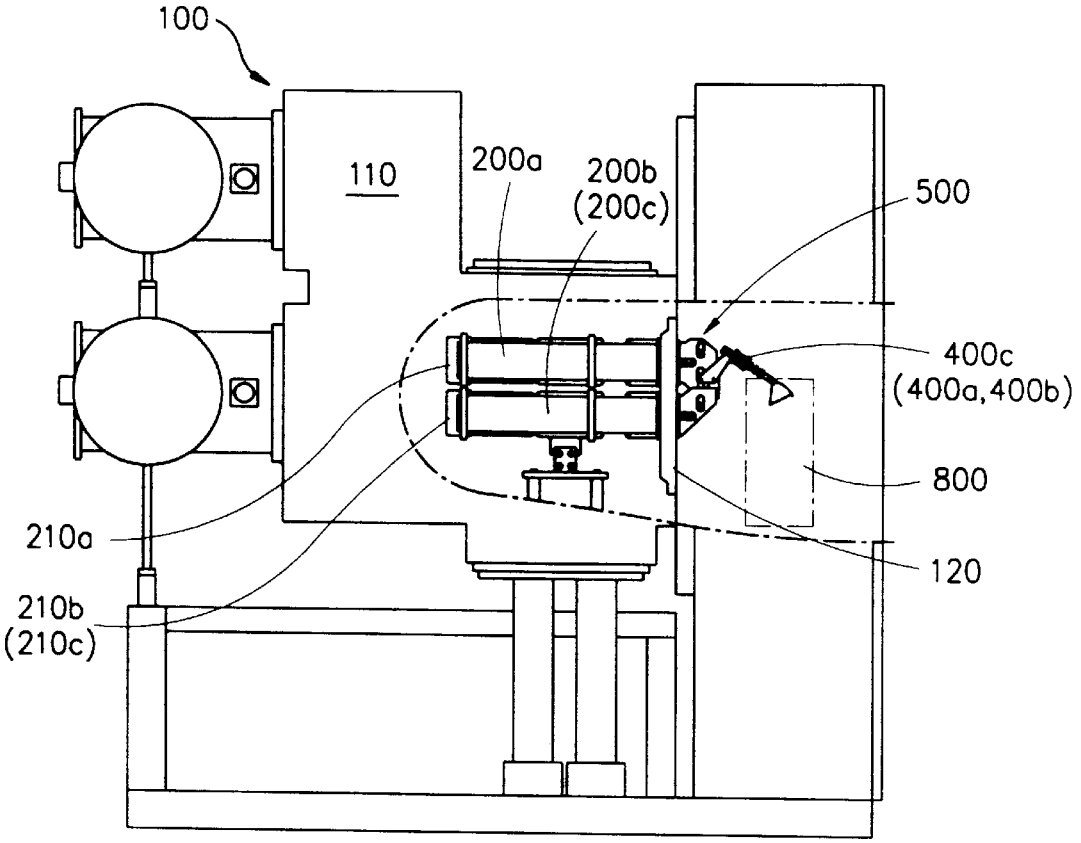
FIG. 3 is a left side view illustrating a partially cut-away portion of a circuit breaker having a trip link structure according to the present invention.
Figure 4:
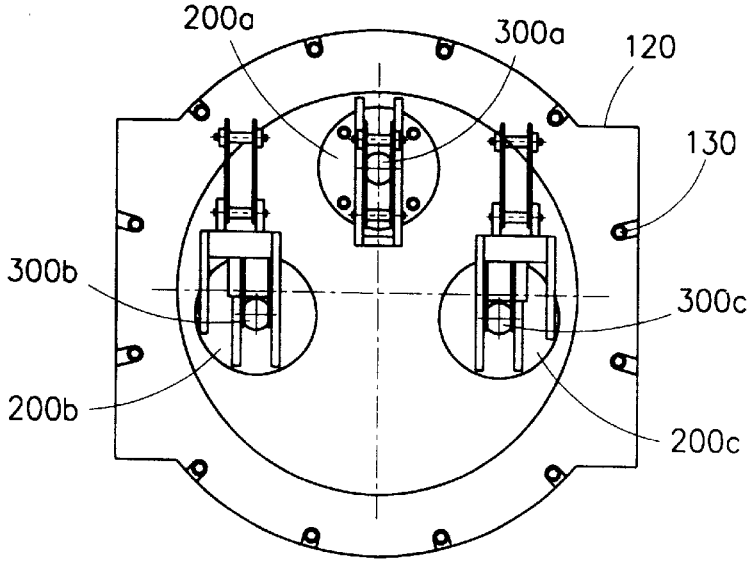
FIG. 4 is a front view illustrating the arrangement of a circuit breaker according to the present invention.

FIG. 3 illustrates a partially cut-away portion of a circuit breaker having a trip link structure according to the present invention, and FIG. 4 illustrates the arrangement of a circuit breaker according to the present invention.

As shown therein, a plurality of circuit breakers are arranged in a container 110 of a main body 100, wherein circuits of each phase are formed in a triangle shape.

Each of the circuit breakers 200*a*, 200*b* and 200*c* includes insulation tubes 206*a*, 206*b* and 206*c*, fixed electrodes 210*a*, 210*b* and 210*c*, vacuum interrupters 209*a*, 209*b* and 209*c* having movable contact points (not shown) and fixed contact points (not shown), and movable electrodes 211*a*, 211*b* and 211*c*. The vacuum interrupters 209*a*, 209*b* and 209*c* are connected with the insulation rods 230*a*, 230*b* and 230*c*, and the insulation rods 230*a*, 230*b* and 230*c* are inserted into the through holes (not shown) formed in the operational rod connection portions 220*a*, 220*b* and 220*c* by the pin joints.

One end of each of the circuit breakers 200*a*, 200*b* and 200*c* is connected with a corresponding input unit through which an electric power is inputted, and the other end of each of the remaining circuit breakers is connected with a corresponding output terminal through which the electric power is outputted.

The other end of each of the circuit breakers 200*a*, 200*b* and 200*c* is connected with the movable contact point 220 of the circuit breakers 200*a*, 200*b* and 200*c* and becomes operational rods 300*a*, 300*b* and 300*c* which are outwardly extended.

A main body engaging plate 120 is engaged to the front surfaces of the operational rods 300*a*, 300*b* and 300*c* by a plurality of fixing pins 130.

The operational rods 300*a*, 300*b* and 300*c* of each phase which are outwardly extended from the main body engaging plate 120 are operably connected with driving levers 400*a*, 400*b* and 400*c* by a link mechanism 500.

In addition, the driving levers 400*a*, 400*b* and 400*c* are connected with the operational mechanism 800, so that the driving levers 400*a*, 400*b* and 400*c* are moved upwardly and downwardly by the inner operation of the operational mechanism 800 for thereby enabling the contacting operation of the circuit breakers 200*a*, 200*b* and 200*c*.

In the drawings, characters "a", "b" and "c" represent the phases of the electric power.

In other words, the phase A of the electric power is given a character "a". The position of the phases may be changed.

Figure 5:
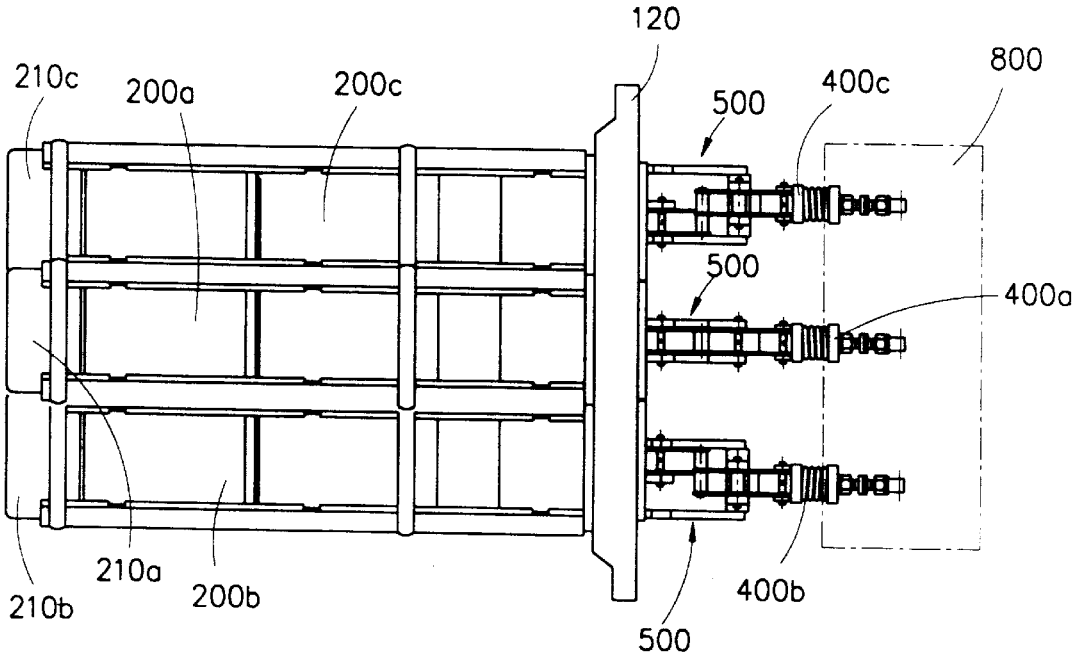
FIG. 5 is a plan view illustrating the structure of a trip link for a circuit breaker according to the present invention.
Figure 6:
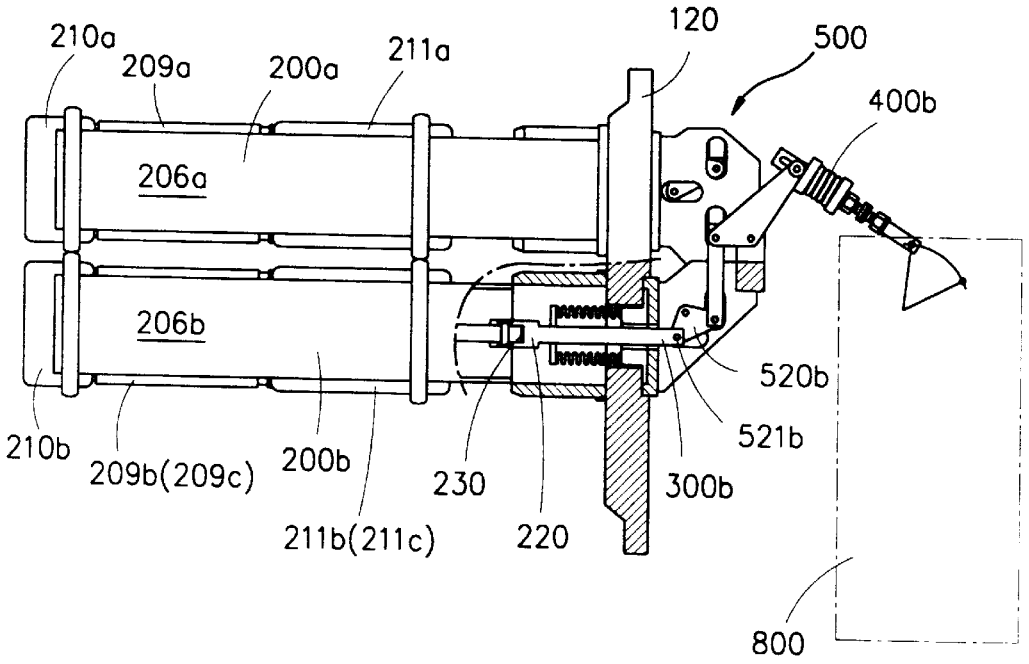
FIG. 6 is a left side view illustrating the structure of a trip link according to the present invention.

FIGS. 5 and 6 illustrates an engagement that the circuit breakers 200*a*, 200*b* and 200*c* are engaged with the link mechanism 500, the driving levers 400*a*, 400*b* and 400*c* and the operational mechanism 800.

As shown in FIGS. 5 and 6, the link mechanism 500 is engaged with the main body engaging plate 120 between the operational rods 300*a*, 300*b* and 300*c* and the driving levers 400*a*, 400*b* and 400*c* of the circuit breakers 200*a*, 200*b* and 200*c*.

Figure 7:
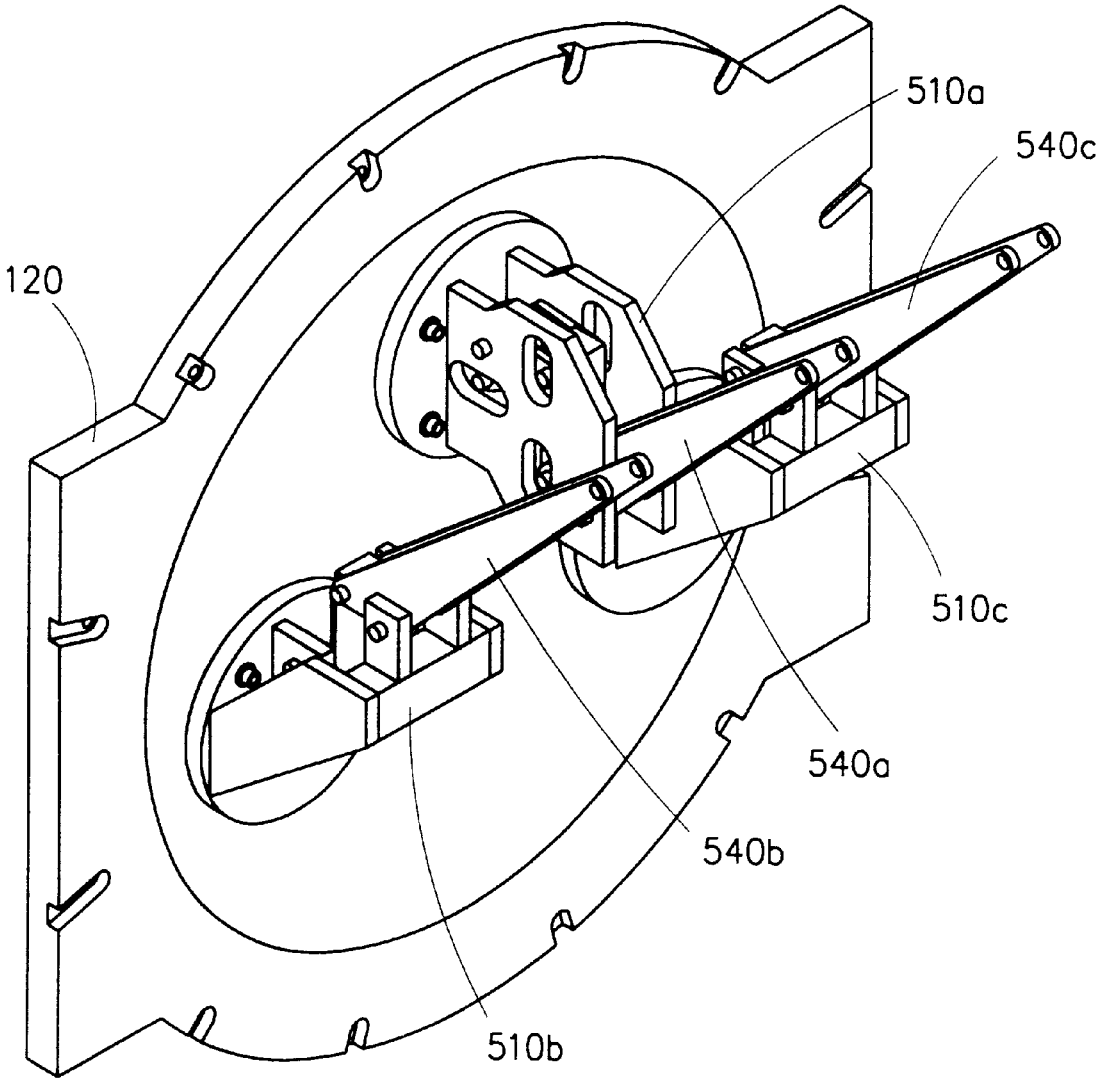
FIG. 7 is a perspective view illustrating a major portion of the structure of a trip link according to the present invention.
Figure 8:
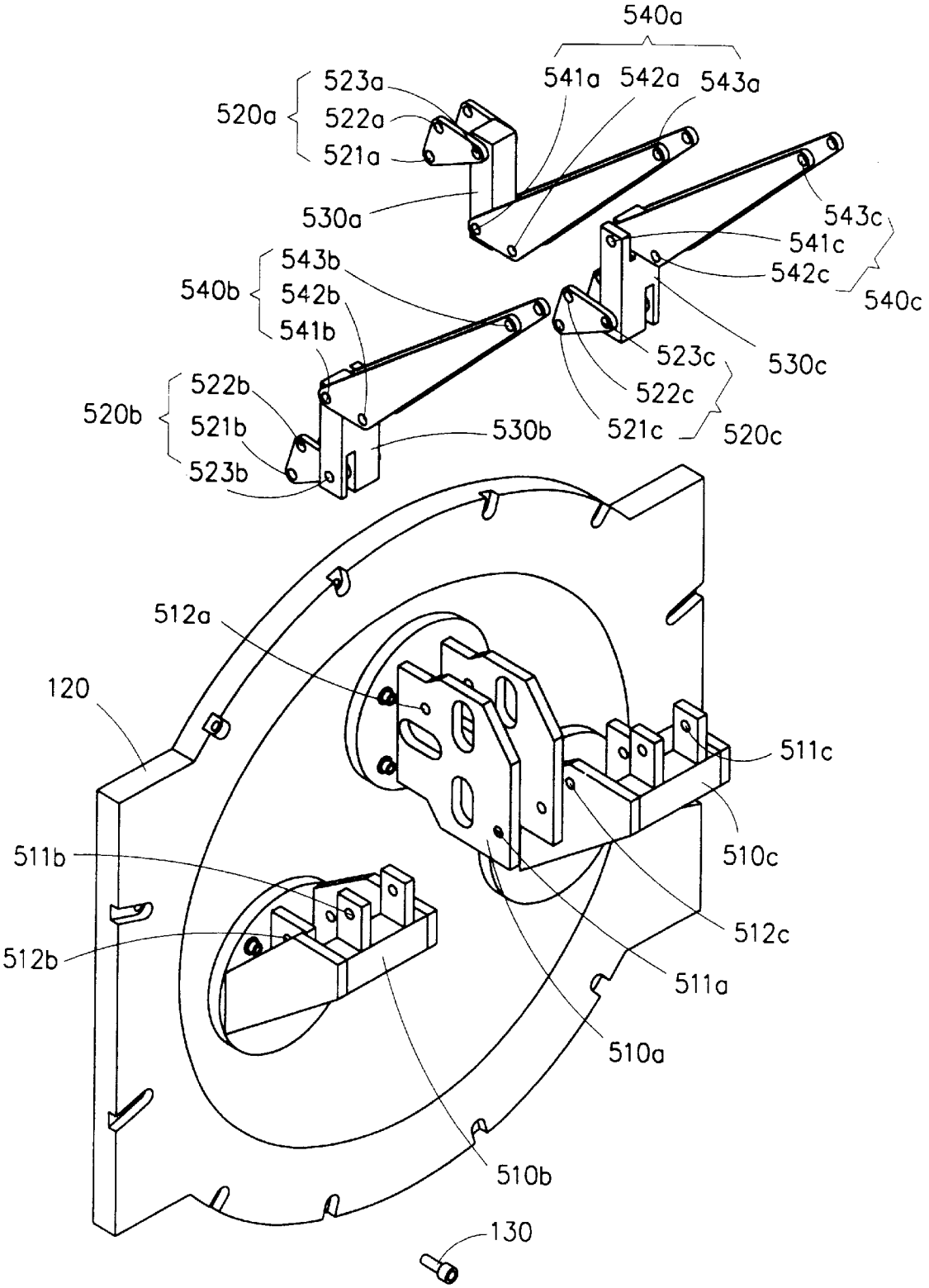
FIG. 8 is a perspective exploded view illustrating a major portion of the structure of a trip link according to the present invention.

The link mechanism 500 will be explained in more detail with reference to FIGS. 7 and 8.

Support brackets 510*a*, 510*b* and 510*c* are engaged to the front surfaces of each phase of the main body engaging plate 120.

The first connection portions 521*a*, 521*b* and 521*c* of the operational link plates 520*a*, 520*b* and 520*c* are connected with the operational rods 300*a*, 300*b* and 300*c*, respectively, and the second connections 522*a*, 522*b* and 522*c* are operably connected with the first connection portions 512*a*, 512*b* and 512*c* of the support brackets 510*a*, 510*b* and 510*c*.

The third connection portions 523*a*, 523*b*, and 523*c* of the operational link plates 520*a*, 520*b* and 520*c* are hinged to end portions of the connection links 530*a*, 530*b* and 530*c*, respectively.

In addition, there are provided connection levers 540*a*, 540*b* and 540*c* in which the other end portions of the connection links 530*a*, 530*b* and 530*c* are hinged to the first connection portions 541*a*, 541*b* and 541*c*, and the second connection portions 542*a*, 542*b* and 542*c* are operably connected with the second connection portions 511*a*, 511*b* and 511*c* of the support brackets 510*a*, 510*b* and 510*c*, and the third connection portions 543*a*, 543*b* and 543*c* are operably connected with the driving levers 400*a*, 400*b* and 400*c*.

The connection link 530*a* which is arranged in the upper portion has upper and lower portions of which the lower portion is connected with the first connection portion 541*a* of the connection lever 540*a* in its lower portion.

The upper portions of the connection links 530*b* and 530*c* which are arranged in the lower portion are connected with the first connection portions 541*b* and 541*c* of the connection levers 540*b* and 540*c*.

The connection points between the driving levers 400*a*, 400*b* and 400*c* and the connection levers 540*a*, 540*b* and 540*c* are formed at the identical height.

At the same time, the downwardly extended length of the upper side connection link 530*a* and the upwardly extended length of the connection links 530*b* and 530*c* are identical, and the connection points between the connection links 530*a*, 530*b* and 530*c* and the connection levers 540*a*, 540*b* and 540*c* are at the identical height, so that the link lengths between the driving levers 400*a*, 400*b* and 400*c* and the operational rods 300*a*, 300*b* and 300*c* of the circuit breakers 200*a*, 200*b* and 200*c* are identical.

The operation of the trip link structure according to the present invention will now be explained.

First, when the driving levers 400*a*, 400*b* and 400*c* are turned clockwise by the inner operation of the operational mechanism 800, the connection levers 540*a*, 540*b* and 540*c* are rotated clockwise with respect to the second connection portions 542*a*, 542*b* and 542*c* supported by the support brackets 510*a*, 510*b* and 510*c*.

As the connection levers 540*a*, 540*b* and 540*c* are rotated, the connection links 530*a*, 530*b* and 530*c* are upwardly moved.

As the connection links 530*a*, 530*b* and 530*c* are upwardly moved, the operational link plates 520*a*, 520*b* and 520*c* are rotated counterclockwise, and the operational rods 300*a*, 300*b* and 300*c* are forwardly pulled, so that the movable contact points 220 of the circuit breakers 200*a*, 200*b* and 200*c* are separated from the fixed contact points 230.

The operational distances between the driving levers 540*a*, 540*b* and 540*c* and the operational rods 300*a*, 300*b* and 300*c* of the circuit breakers 200*a*, 200*b* and 200*c* are identical, so that the movable contact points 220 are concurrently separated from the fixed contact points 230.

In the state that the fixed contact points 230 are separated, when the movable contact points 220 are connected again, the connection operation is implemented by the reverse sequence of the separation sequence.

As described above, in the trip link structure of a circuit breaker according to the present invention, a plurality of circuit breakers are arranged in a triangle shape by one unit consisting of three circuit breakers, so that the entire construction of the circuit breaker is minimized by decreasing the width and height of the circuit breaker. In addition, it is possible to enable a smooth operation by forming the identical operational distance between the driving lever and the operational rod of the circuit breaker.

Although the preferred embodiment of the present invention have been disclosed for illustrative purposes, those skilled in the art will appreciate that various modifications, additions and substitutions are possible, without departing from the scope and spirit of the invention as recited in the accompanying claims.

What is claimed is:

1. A trip link structure for a circuit breaker unit having an operational mechanism for operating driving levers corresponding to each phase of electric power, comprising:

a plurality of circuit breakers arranged in a triangle shape and each having a fixed contact point and a movable contact point formed therein as corresponding to one of three phases and each having an operational rod connected with a corresponding movable contact point;

a main body engaging plate engaged to a front surface of each of said plurality of circuit breakers;

support brackets each engaged to a front surface of said main body engaging plate as corresponding to a respective one of said plurality of circuit breakers;

operational link plates each having a first connection portion hinged to respective ones of the operational rods and each having a second connection portion supported by first connection portions of respective ones of said support brackets;

a first connection link having an upper end hinged to a third connection portion of a respective one of said operational link plates connected with a respective one of said plurality of circuit breakers within an upper side portion of the circuit breaker unit for thereby being downwardly extended;

second and third connection links each having a lower end hinged to third connection portions of respective ones of said operational link plates connected with respective ones of said circuit breakers within a lower side portion of the circuit breaker unit for thereby being upwardly extended;

a first connection lever having a first connection portion connected with a lower end of said first connection link, a second connection portion supported by a second connection portion of a respective one of said support brackets, and a third connection portion hinged to a first driving lever; and second and third connection levers each having first connection portions respectively connected with lower ends of said second and third connection links, second connection portions supported by second connection portions of respective ones of said support brackets, and third connection portions hinged to respective second and third driving levers.

2. The trip link structure of claim 1, wherein said plurality of circuit breakers are arranged to have an inverted triangle shape.

3. A trip link structure for a circuit breaker unit comprising:

a plurality of circuit breakers each having a contact point and an operational rod movably connectable to the contact point;

support brackets each mounted on a front surface of the circuit breaker unit and corresponding to respective ones of said plurality of circuit breakers;

operational link plates each pivotably mounted on respective ones of said support brackets and pivotably engaged with respective ones of the operational rods to linearly displace the operational rods;

connection links each coupled to respective ones of said operational link plates for rotating said operational link plates to pivot about said support brackets; and connection levers each coupled to respective ones of said connection links and pivotably mounted on respective ones of said support brackets for linearly displacing said connection links.

4. The trip link structure for a circuit breaker unit of claim 3, wherein said plurality of circuit breakers comprise three circuit breakers arranged within the circuit breaker triangularly with respect to each other.

5. The trip link structure for a circuit breaker unit of claim 4, wherein said connection links comprise first, second and third connection links, the first connection link having an upper end hinged to a respective one of said operational link plates corresponding to a first circuit breaker arranged within a relatively upper portion of the circuit breaker unit, and the second and third connection links each having a lower end hinged to respective ones of said operational link plates arranged within relatively lower portions of the circuit breaker unit.

6. The trip link structure for a circuit breaker unit of claim 5, wherein said connection levers comprise first, second and third connection levers, the first connection levers being coupled to a lower end of the first connection link and the second and third connection levers being respectively coupled to upper ends of the second and third connection links.

7. The trip link structure for a circuit breaker unit of claim 3, wherein said plurality of circuit breakers comprise three circuit breakers, operational rods of the first and second circuit breakers protruding from the front surface at respective locations across from each other along a periphery of the front surface and an operational rod of the third circuit breaker protruding from the front surface at a location along the periphery of the front surface midway between the respective locations of the operational rods of the first and second circuit breakers.

8. The trip link structure for a circuit breaker unit of claim 3, wherein said plurality of circuit breakers correspond to respective phases of a three-phase power source.

9. The trip link structure for a circuit breaker unit of claim 3, wherein the front surface comprises a main body engaging plate.

10. The trip link structure for a circuit breaker unit of claim 3, further comprising an operational mechanism for operating said connection levers.

11. A trip link structure for a circuit breaker unit comprising:

a circuit breaker having a contact point and an operational rod movably connectable to the contact point;

a support bracket mounted on a front surface of the circuit breaker unit;

an operational link plate pivotably mounted on said support bracket and pivotably engaged with the operational rod to linearly displace the operational rod;

a connection link coupled to said operational link plate for rotating said operational link plate to pivot about said support bracket; and a connection lever coupled to said connection link and pivotably mounted on said support bracket for linearly displacing said connection link.

12. The trip link structure for a circuit breaker unit of claim 11, further comprising an operational mechanism for operating said connection lever.

* * * * *